United States Patent [19]

Sakai et al.

[11] Patent Number: 4,662,739

[45] Date of Patent: May 5, 1987

[54] METHOD OF CONTROLLING COPYING MACHINE OPERATION

[75] Inventors: Yoshihiro Sakai, Tokyo; Yutaka Koizumi, Kawasaki; Mitsuru Mamizuka, Tokyo; Hideya Furuta, Yokohama, all of Japan

[73] Assignee: Ricoh Company, Ltd., Tokyo, Japan

[21] Appl. No.: 812,950

[22] Filed: Dec. 24, 1985

[30] Foreign Application Priority Data

Dec. 29, 1984 [JP] Japan ..... 59-276679
Dec. 29, 1984 [JP] Japan ..... 59-276680

[51] Int. Cl.[4] ..... G03G 15/16; G03G 15/01

[52] U.S. Cl. ..... 355/14 R; 355/4; 355/14 SH; 355/14 TR

[58] Field of Search ..... 355/4, 3 TR, 3 R, 14 R, 355/14 SH, 14 TR

[56] References Cited

U.S. PATENT DOCUMENTS 4,531,828 7/1985 Hoshino ..... 355/4

*Primary Examiner*—R. L. Moses

*Attorney, Agent, or Firm*—Oblon, Fisher, Spivak, McClelland & Maier

[57] ABSTRACT

In a copying apparatus which comprises a plurality of rotatable photosensitive members and an image transfer belt rotatably movable in synchronism with the photosensitive members and in which visible image formed on the photosensitive members are transferred onto a transfer paper carried by the transfer belt, a pair of sensors are arranged around the transfer belt which has a pair of marks thereon and an initiation and a termination of a preprocess are performed prior to a copying process on the basis of detections of these marks by the sensors.

2 Claims, 3 Drawing Figures

METHOD OF CONTROLLING COPYING MACHINE OPERATION

BACKGROUND OF THE INVENTION

The present invention relates to a copying maching having a plurality of photosensitive members and an image transfer belt movable in synchronism with rotations of the photosensitive members for transferring visible images formed on the photosensitive members onto a transfer paper carried by the transfer belt and, particularly to a method for controlling an operation of the copying machine.

In a conventional copying machine of such type as mentioned above, a copy is obtained through a copying process including the steps of electrostatically charging the photosensitive members, esposing the photosensitive members with an original image to form latent images thereon, developing them, transferring the developed images onto the copy paper and cleaning them for subsequent use. Prior to this process, the photosensitive members may be preprocessed to remove electric charges thereon and clean them up.

The process including the preprocess, if any, is generally sequence-controlled by using encoder pulses generated in synchronism with revolutions of the photosensitive members. That is, the process is controlled according to revolutions of the photosensitive members. When a movement of the transfer belt is in synchronism with the photosensitive members, it can be said that the process is controlled by the transfer belt. However, such synchronism is obtained after a certain portion of the transfer belt is positioned at a predetermined location on a path thereof, a relative position of the transfer belt with respect to the copying process depends upon a setting of the transfer belt in the copying machine. In a case where the transfer belt has a seam, a relative position of the seam with respect to the process becomes fixed after the transfer belt is incorporated in the copying machine. However, an absolute position of the seam may vary with respect to the process.

When the transfer belt is set in the copying machine such that the seam thereof comes into an image transfer position on the belt during a visible image transfer from one of the photosensitive members to the transfer paper carried on the belt, there may be an incomplete contact of the transfer paper with the photosensitive members due to a presence of the seam, resulting in a partially blurred image on the transfer paper.

SUMMARY OF THE INVENTION

In view of the state of art mentioned above, an object of the present invention is to provide a control method for a copying machine operation according to which the relative position of the transfer belt with respect to the copying process can be easily set in an optimum state.

According to the present invention, the above object can be achieved by starting the movement on the transfer belt upon a detection of a first mark provided on the transfer belt arranged in the copying machine having a plurality of photosensitive members on which visible images are formed and from which the visible images are transferred onto a transfer paper carried by the transfer belt by means of a first sensor provided in the vicinity of a portion of the transfer belt, driving all of the photosensitive members to rotate by at least one revolution during a time period from the detection of the first mark to a detection of a second mark provided on the transfer belt by means of a second sensor provided in the vicinity of another portion of the transfer belt to preprocess the photosensitive members, starting a copying process upon the detection of the second mark and terminating the operations of the photosensitive members and transfer belt upon a second detection of the first mark subsequent to a completion of the copying process. That is, the optimum relative position of the transfer belt with respect to the copying process is freely and easily determined by merely arranging the first and second marks on the transfer belt and providing the first and second sensors around the transfer belt correspondingly.

DESCRIPTION OF THE PREFERRED EMBODIMENTS

Figure 1:
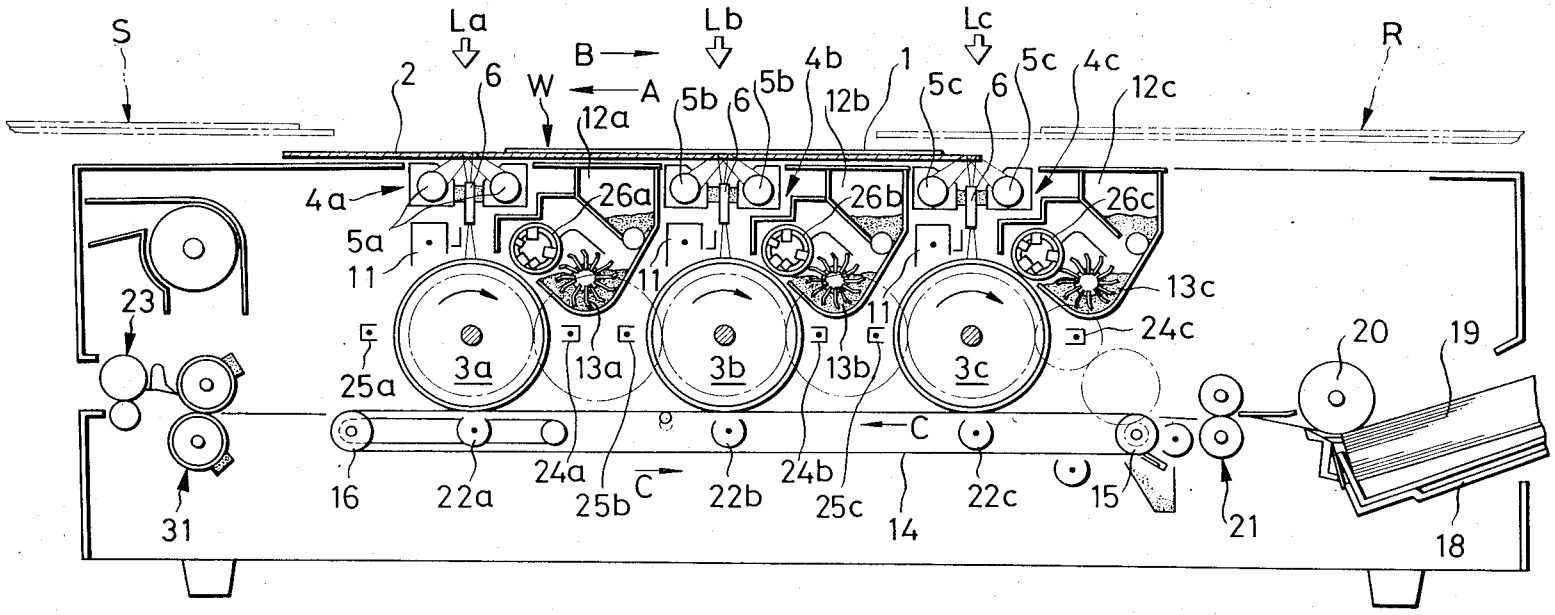
FIG. 1 is a schematic cross-section of a color copying machine to which the present invention is applied.

First of all, an overall operation of the color copying machine shown in FIG. 1 will be described. In FIG. 1, an original 1 having a color image is mounted on an original mounting table 2 with a surface thereof having the image being down. The mounting table 2 is in a ready position W shown by a solid line during a time in which any copying operation is out of order, and is shifted in a direction A to a copy start position shown by a chain line S upon a start of copying operation. Then the mounting table 2 is moved in a direction B to a return position shown by a chain line R during the copying operation and is returned to the ready position W upon a completion of the copying operation. The reciprocation of the mounting table 2 is performed in a level although it is shown as being performed in different levels in FIG. 1 for clarification purpose.

Below the path of the mounting table 2, a first, second and third photosensitive members 3*a*, 3*b* and 3*c*, each being in the form of drum having a common diameter, are arranged with a certain space between adjacent drums and a first, second and third exposing devices 4*a*, 4*b* and 4*c* are disposed correspondingly to the respective photosensitive drums between the mounting table 2 and the photosensitive drums, respectively. A distance between supporting shafts of the adjacent ones of the photosensitive drums 3*a*, 3*b* and 3*c* is set as a half of a peripheral length of the drum.

The exposing devices 4*a*, 4*b* and 4*c* include illumination lamps 5*a*, 5*b* and 5*c*, respectively. Each lamp is cooperated with a gradient-index rod lenses array 6 and transmitting members. The lamps 5*a*, 5*b* and 5*c* of the first, second and third exposing devices 4*a*, 4*b* and 4*c* emit red light, green light and blue light, respectively.

The original 1 mounted on the mounting table 2 is illuminated by the lamps 5*a*, 5*b* and 5*c*, successively, when the mounting table 2 moves from the start position S in the direction B, and reflected lights from the original 1 are passed through the respective arrays 6 of the exposing devices 4*a*, 4*b* and 4*c* to the photosensitive drums 3*a*, 3*b* and 3*c* to expose them with color decomposed images, respectively.

The color decomposed images are in mirror-image relation to the color image of the original 1 on the mounting plate 2, in other words, these images are not inverted with respect to the moving direction B of the original 1. Therefore, in order to condense the color decomposed images on the respective photosensitive drums 3*a* to 3*c* without causing them to be deviated from each other on a final color copy, a surface portion of each photosensitive drum which is just in an exposing position must move in the same direction as the moving direction of the original 1. Therefore, the respective photosensitive drums 3*a* to 3*c* are rotated clockwisely.

The photosensitive drums 3*a*, 3*b* and 3*c* which are rotating clockwisely are electrostatically charged uniformly by chargers 11 disposed in upstream sides of the photosensitive drums, respectively, prior to the exposures with the color decomposed images by the exposing devices 4*a* to 4*c*, respectively.

When the electrostaticaly charged photosensitive drums 3*a*, 3*b* and 3*c* are exposed by the exposing devices 4*a*, 4*b* and 4*c*, respectively, latent images are formed thereon which move along the clockwise rotations of the photosensitive drums to positions opposing to developing devices 12*a*, 12*b* and 12*c*, respectively. The developing device 12*a* corresponding to the first photosensitive drum 3*a* which is exposed with red light contains a cyan color developer 13*a* which is a complemental color of red, the developing device 12*b* corresponding to the second photosensitive drum 3*b* contains a magenta color developer 13*b* which is a complemental color of green and the developing device 12*c* corresponding to the third photosensitive drum 3*c* contains a yellow color developer 13*c* which is a complemental color of blue. Thus, the electrostatic latent images on the photosensitive drums are developed with cyan, magenta and yellow colors, respectively, in succession, while passing through the developing devices 12*a* to 12*c*, so that visible images of cyan color component, magenta color component and yellow color component of the original image are formed on the first, second and third photosensitive drums 3*a*, 3*b* and 3*c*, respectively.

The charging, exposing and developing steps of the copying process have been described for each photosensitive drum. It should be noted, however, that timings of these steps are different by drum. That is, for example, the exposing step for the exposing device 4*a* corresponding to the photosensitive drum 3*a* is performed when the original 1 reaches an illumination position La and those for the exposing devices 4*b* and 4*c* are performed when the original 1 reaches illumination positions Lb and Lc, respectively. Therefore, the exposing step for the photosensitive drum in the most upstream side with respect to the moving direction B of the mounting table 2, i.e., the first photosensitive drum 3*a*, is performed firstly and then for the photosensitive drums 3*b* and 3*c* in the order. The difference in exposing timing between the photosensitive drums 3*a* and 3*b* is equal to a time required for the mounting plate 2 to move from the position La to the position Lb and that between the photosensitive drums 3*b* and 3*c* is equal to a time required for the table to move from the position Lb to the position Lc. The timings of electrostatic charging as well as developing for the respective photosensitive drums are also different from each other correspondingly.

Figure 2:
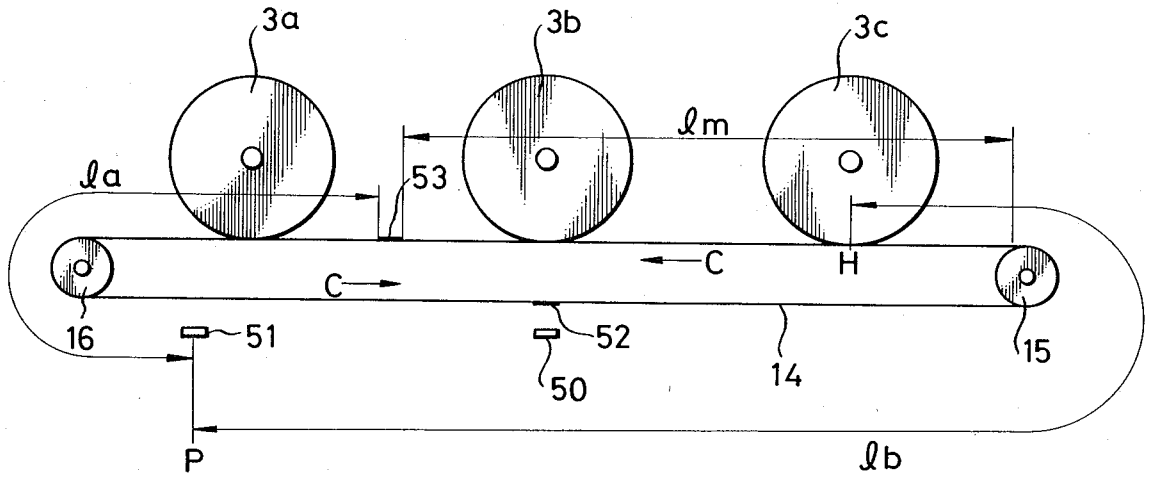
FIG. 2 shows an operational relation of sensors to marks provided on a transfer belt.

In the embodiment shown in FIG. 1 and 2, the distance between the illumination positions La and Lb and the distance between the positions Lb and Lc are commonly made equal to a distance between supporting shafts of the photosensitive drums 3*a* and 3*b* which is equal to the distance between the shafts of the photosensitive drums 3*b* and 3*c* and corresponds to a half of the peripheral length of the photosensitive drum. Therefore, when the mounting table 2 moves to the second illumination position Lb and the exposing step is initiated for the second photosensitive drum 3*b* after the first photosensitive drum 3*a* is exposed in the first illumination position La, a front edge portion of the latent image on the drum 3*a* is moved by a distance corresponding to the half of the peripheral length of the drum 3*a* and is developed by the developing device 12*a* already. Similarly, when the mounting plate 2 is moved from the second illumination position Lb to the third illumination position Lc and the exposure for the third photosensitive drum 3*c* is started, the developed front edge portion of the latent image of the first photosensitive drum 3*a* is fully revolved and a front edge portion of the latent image on the second photosensitive drum 3*b* is revolved by 180°, already. Therefore, the formations of the latent images on the first, second and third photosensitive drums 3*a*, 3*b* and 3*c* are performed at different timings in the order and thus the developments thereof are performed at different timings correspondingly.

A thin transfer belt 14 of such as polyester film is disposed below the photosensitive drums 3*a* to 3*c*. The transfer belt 14 extends over a drive roller 15 and a driven roller 16 and moves in a direction shown by an arrow C. Transfer papers 19 stored in a transfer belt 14 are fed by a feedroller 20 and a register roller 21 onto the transfer belt 14 successively and are moved in the direction C by the belt 14. During this movement, each transfer paper contacts with the third, second and first photosensitive drums 3*c*, 3*b* and 3*a* successively in the order and the latent images on the photosensitive drums are transferred onto the transfer paper in an overlapping relation by transfer chargers 22*c*, 22*b* and 22*a*.

Discharging lamps 24*c*, 24*b* and 24*a* disposed in upstream sides of the respective transfer chargers 22*c*, 22*b* and 22*a* function to at least lower potentials of the respective photosensitive drums prior to the image transfer operations of them. Discharging lamps 25*c*, 25*b* and 25*a* disposed in downstream sides of the respectivve transfer chargers 22*c*, 22*b* and 22*a* function to remove residual potentials of the respective photosensitive drums after the images thereon are transferred to the transfer paper. The cleaning operation for the photosensitive drums is performed subsequently. This is done by changing bias voltages applied to developing sleeves 26*c*, 26*b* and 26*a* disposed in the developing devices 12*c*, 12*b* and 12*a*, respectively, from that necessary for the developments to that necessary for cleaning.

The transfer paper, after the last visible image is transferred from the first photosensitive drum 3*a*, is separated from the transfer belt 14 with an aid of paper bending action given by the driven roller 16 and then fed to a pair of fixing rollers 31 in which the composite color image on the transfer paper is fixed. The latter is then ejected from the copying machine by an ejection roller 23.

The register roller 21 functions to stop the transfer paper fed by the feedroller 20, temporarily, and then send the paper to the transfer belt 14 at such timing that the front edge of the latent image on the third photosensitive drum 3*c* coincides, in position, with a front end of a desired image portion of the transfer paper so that the image on the photosensitive drum 3*c* is transferred onto the transfer paper in a transfer position thereof, i.e., the position in which the image transfer is performed by the transfer charger 22*c*.

As mentioned, the latent images are formed on the respective photosensitive drums 3*a* to 3*c* successively with an interval corresponding to the half peripheral length of the photosensitive drum. Therefore, the visible images are obtained by the respective developing devices 12*a* to 12*c* with the same interval. Since the distance between the transfer positions is kept as the half peripheral length of the photosensitive drum, the visible images transferred from the photosensitive drums are overlapped exactly and thus a resultant composite color image on the transfer paper has no color deviation.

As will be clear from the foregoings, the first photosensitive drum 3*a* on which the latent image is formed by the exposing device 4*a* continues to rotate while holding the latent image being developed until the transfer operation thereof is started after those of the third and second photosensitive drums 3*c* and 3*b* are completed. Similarly, the second photosensitive drum 3*b* having the latent image continues to rotate until the transfer operation for the photosensitive drum 3*c* is completed.

The photosensitive drums which rotate while holding their latent images should not be in contact with the transfer belt 14, otherwise the latent images may be distorted by the transfer belt. Therefore, it is desired to design the copying machine such that at least portions of the transfer belt 14 which are otherwise in contact with the first and/or second photosensitive drums 3*a* and 3*b* can be vertically shifted selectively to allow these drums to rotate without containing with the transfer belt 14 until the image transfer for the preceding photosensitive drum is completed and to rotate with contacting with the transfer belt 14 only when the transfer operation for it is to be performed.

In the color copying apparatus described hereinbefore which performs the copying process including the steps of electrostatically charging the photosensitive drums 3*a* to 3*c* by using the chargers 11, exposing these drums by using the exposing devices 4*a* to 4*c*, developing the latent images thereon by using the developing devices 12*a* to 12*c*, transferring the developed images onto the transfer paper by using the transfer chargers 22*a* to 22*c* and discharging them by using the discharging lamps 25*a* to 25*c*, a first sensor 50 is arranged in the vicinity of a center portion of a lower portion of the transfer belt 14 and a second sensor 51 ia arranged in a left side of the sensor 50 i.e., in an upstream side of the sensor 50 with respect to the moving direction of the transfer belt 14. These sensors act as an input unit to a microcomputer not shown.

A first mark 52 is provided on the transfer belt 14 such that the first sensor 50 detects it when it comes into a detection area of the sensor 50 and sends a detection signal to the microcomputer.

A second mark 53 is provided on the transfer belt 14. In the shown state in which the first mark 52 is just detected by the first sensor 50, a location of the second mark 53 on the transfer belt 14 is in advance of a detection point P of the second sensor 51 by at least a distance la corresponding to the peripheral length of the photosensitive drum. When the second mark 53 comes into a detection area of the second sensor 51 along with the movement of the transfer belt 14, the fact is signalled by the second sensor 51 to the microcomputer.

Figure 3:
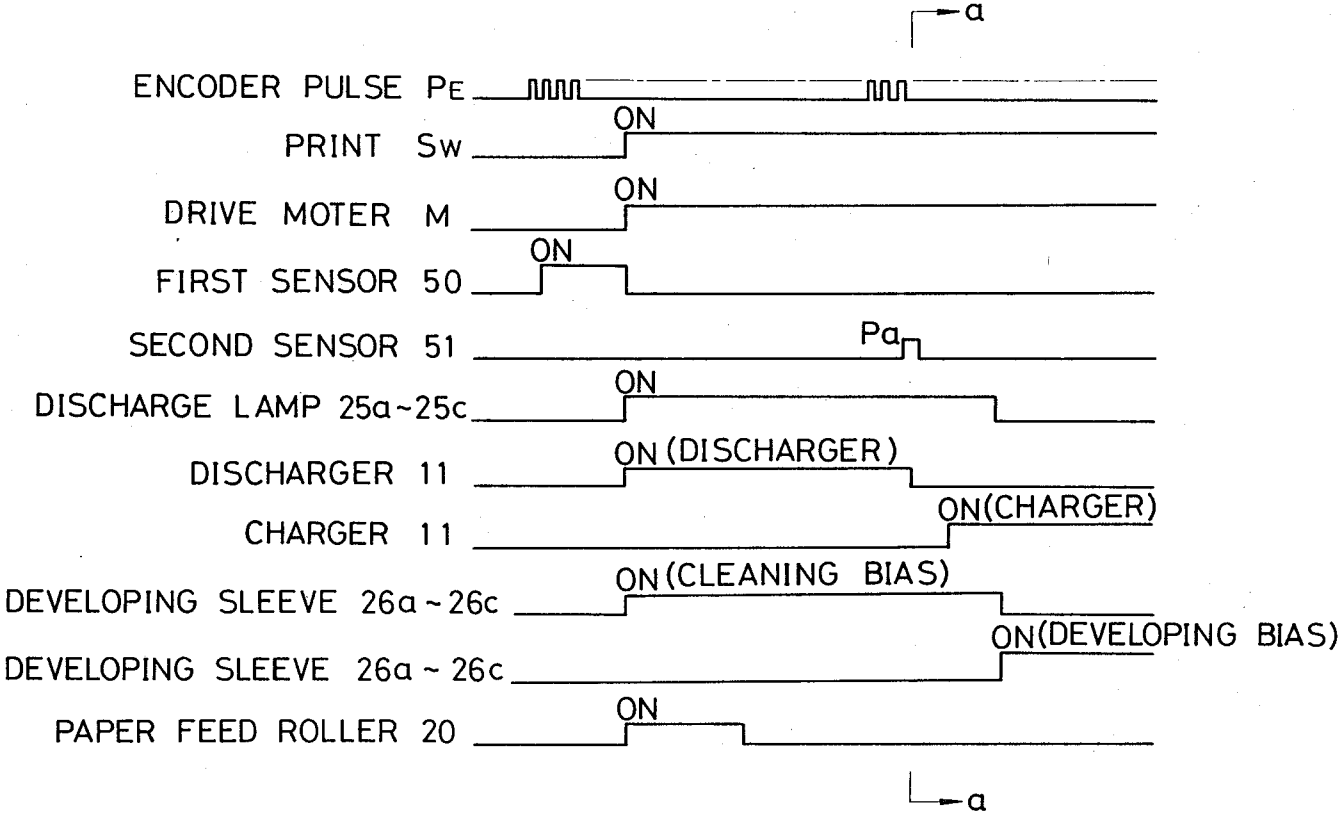
FIG. 3 is a time chart showing the preprocess.

In this embodiment, the preprocessing which includes the discharging and cleaning steps for the surfaces of the photosensitive drums 3*a* to 3*c* is performed after the copy initiation instruction and before the copying process. That is, as shown in FIG. 3, when a copy switch is turned on to instruct a commencement of the copying operation, the drive motor M is actuated to rotate the photosensitive drums 3*a* to 3*c*. At the same time, after confirming that the first sensor 50 detects the first mark 52, the discharge lamps 25*a* to 25*c* are lit and a discharger is actuated to discharge the photosensitive drums 3*a* to 3*c*. The charger 11 can also be used as the discharger by changing the voltage applied thereto. Furthermore, at this time, the surfaces of the photosensitive drums 3*a* to 3*c* are cleaned by applying thereto a biasing voltage to the developing sleeves 26*a* to 26*c*.

When the photosensitive drums 3*a* to 3*c* thus cleaned complete one revolution, respectively, the second mark 53 on the transfer belt 14 which moves in synchronism with the drums 3*a* to 3*c* is detected by the second sensor 51. When a detection signal Pa from the latter is sent to the microcomputer, the prepocessing is completed and the copying process is introduced. As mentioned previously, the copying process for the photosensitive drum 3*b* is performed with a delay corresponding to the half peripheral length of the drum with respect to the copying process for the drum 3*a* and that for the drum 3*c* is performed with the same delay with respect to that for the drum 3*b*. Therefore, the process timings for these photosensitive drums after an output signal Pa of the second sensor 51 are different from each other.

In FIG. 3, a portion following a time instance (a) shows operation timings of various components associated with the first photosensitive drum 3*a*. A sequence control, after commencement of the copying process, is performed on the basis of an encoder pulse PE produced according to the revolution of any of the photosensitive drums 3*a* to 3*c*. That is, the output signals of the first and second sensors 50 and 51 are not used for the purpose of sequence control.

When the copying process commences, the charging, exposing, developing, transferring and cleaning steps are performed sequentially for each copy as mentioned previously. After the process completes and the first sensor 50 detects the first mark 52, the photosensitive drums 3*a* to 3*c* and the transfer belt 14 are stopped to operate.

In the shown embodiment, the preprocess is performed at timings determined by the detections of the first and second marks 52 and 53 by the first and second sensors 50 and 51. Therefore, it is possible to arbitrarily set a relative position of the transfer belt 14 with respect to the copying process by suitably setting positions of the first and second marks 52 and 53. For example, when the transfer belt has a seamed surface portion and it is desired to position the transfer belt 14 such that any undesired effect of the seam on the copying process is avoided, the positions of the sensors 51 and 52 and the marks 52 and 53 are selected such that a distance between the detection point P of, for example, the second sensor 51 and the transfer position H where an image transfer from the third photosensitve drum 3*c* commences is equal to a distance of the transfer belt 14 moved for a time from a start time of the copying process, i.e., a start time of charging of the first photosensitive drum 3*a* by means of the charger 11, to a start time of the image transfer at the transfer position H, as shown in FIG. 2.

In this case, the second mark 53 is provided on the transfer belt 14 such that the seam of the transfer belt 14 does not come into a range lm measured from the second mark 53 in downstream side, where lm is the maximum length of the transfer paper 19 to be used.

That is, the copying process commences at a time when the second sensor 51 detects the second mark 53 as mentioned previously. Therefore, by setting the distance between the points P and H as mentioned above, the second mark 53 reaches the transfer point H when the image transfer operation commences for the third drum 3*c* and, thus, a front end of the transfer paper 19 (FIG. 1) comes to the position of the second mark 53. If the seam were within the range lm, the seam could overlap with the transfer paper in transferring a visible image thereonto, resulting in a drop out of a portion of the visible image on the transfer paper.

Even when the distance between the points P and H is not equal to the moving distance of the transfer belt 14 for the time from the initiation of the copying process to the initiation of the image transfer, the position of the seam can be easily determined from the position of the second mark 53 similarly.

As to a feeding timing of the transfer paper 19 through the feed roller 20 to the register roller 21, it is enough to rotate the feed roller 20 such that the transfer paper 19 reaches the latter prior to a commencement of rotation of the register roller 21 with a predetermined timing. However, it may be preferred to set the feeding timing of the transfer paper 19 through the feed roller 20 such that the transfer paper 19 is sent to the register roller 21 during a rotation of the feed roller 20 which rotates for a time from a depression of the copy switch to a generation of the signal Pa by the second sensor 51 upon a detection of the second mark 53, i.e., during the preprocess is performed.

In general, the transfer paper moving from the paper storage 18 to the register roller 21 tends to jam. With such jamming, the operation of the copying machine is usually stopped temporarily to remove the jammed papers and then restarted to operate. This will disturb the sequence control of the copying process when such jamming occurs during the copying process is running. According to the present invention, since the transfer paper 19 is sent to the register roller 21 during the preprocessing period, any jamming occurring in the period does not affect the copyng process and, thus, useless operations of various components of the copying machine can be avoided.

What is claimed is:

1. A process control method for a copying apparatus having a plurality of rotatable photosensitive members and an image transfer belt rotatable in synchronism with said photosensitive members for transferring visible images formed on said photosensitive members onto a transfer paper carried by said transfer belt, comprising the steps of;

confirming a detection of a first mark provided on said transfer belt by a first sensor provided in the vicinity of said transfer belt, initiating rotations of said photosensitve members upon said confirmation such that each of said photosensitve members completes at least on revolution prior to a detection of a second mark provided on said transfer belt by a second sensor provided in the vicinity of said transfer belt after said first mark is detected by said first sensor, performing a preprocess for said photosensitive members during at least one revolution of each of said photosensitive members, initiating a copying process upon said detection of said second mark by said second sensor, and terminating movements of said photosensitive members and said transfer belt upon a subsequent detection of said first mark by said first sensor to said detection of said second mark by said second sensor.

2. The method as claimed in claim 1, wherein said transfer paper is sent by a feed roller from a transfer paper storage to a register roller during said preprocess is performed.

* * * * *